US006909988B2

(12) United States Patent
Batzinger et al.

(10) Patent No.: US 6,909,988 B2
(45) Date of Patent: Jun. 21, 2005

(54) METHOD FOR POSITIONING DEFECTS IN METAL BILLETS

(75) Inventors: Thomas James Batzinger, Burnt Hills, NY (US); Michael Francis Xavier Gigliotti, Jr., Scotia, NY (US); Bernard Patrick Bewlay, Schenectady, NY (US); Shesh Krishna Srivatsa, Cincinnati, OH (US)

(73) Assignee: General Electric Company, Niskayuna, NY (US)

( * ) Notice: Subject to any disclaimer, the term of this patent is extended or adjusted under 35 U.S.C. 154(b) by 109 days.

(21) Appl. No.: 10/270,472

(22) Filed: Oct. 15, 2002

(65) Prior Publication Data

US 2004/0073401 A1 Apr. 15, 2004

(51) Int. Cl.[7] ..... B24B 19/00

(52) U.S. Cl. ..... 702/181; 702/182; 702/183; 702/184; 702/185; 73/602; 73/610; 451/5; 451/8

(58) Field of Search ..... 702/181–185; 73/602, 610; 419/28; 451/5, 8; 72/3, 4, 6.1, 7.1; 164/466, 476, 46, 485, 459, 146

(56) References Cited

U.S. PATENT DOCUMENTS 3,657,638 A * 4/1972 Holler et al. ..... 324/213
3,693,074 A * 9/1972 Holler et al. ..... 324/213
3,825,821 A * 7/1974 Forster ..... 324/216
4,004,454 A * 1/1977 Matay ..... 73/610
4,112,626 A * 9/1978 Watanabe et al. ..... 451/6
4,247,819 A * 1/1981 Shimada et al. ..... 324/233
4,258,319 A * 3/1981 Shimada et al. ..... 324/226
RE31,355 E * 8/1983 Rozmus ..... 419/49
4,458,155 A * 7/1984 Gruner et al. ..... 250/559.48
4,537,073 A * 8/1985 Ooshiro et al. ..... 73/602
4,541,011 A * 9/1985 Mayer et al. ..... 348/133
4,562,349 A * 12/1985 Stumm ..... 250/234
4,633,620 A * 1/1987 Lorenzi et al. ..... 451/6
4,673,124 A * 6/1987 Conolly ..... 228/170
4,762,679 A * 8/1988 Gegel et al. ..... 419/28
4,912,664 A 3/1990 Weiss et al.
5,106,012 A 4/1992 Hyzak et al.
5,167,157 A 12/1992 Wertz et al.
5,377,116 A 12/1994 Wayne et al.
5,475,797 A * 12/1995 Glaspy et al. ..... 700/247
5,533,401 A 7/1996 Gilmore
5,569,860 A 10/1996 Aizawa et al.
5,629,865 A 5/1997 Roth
5,915,277 A 6/1999 Patton
6,035,243 A * 3/2000 Galuga et al. ..... 700/110

* cited by examiner

*Primary Examiner*—Patrick Assouad
*Assistant Examiner*—Carol S. W. Tsai
(74) *Attorney, Agent, or Firm*—Penny A. Clarke; Patrick K. Patnode

(57) ABSTRACT

A process for positioning at least one defect in a billet being forged into an article is described. The size and location of the billet is first determined, using a non-destructive test such as ultrasonic inspection. The movement of the defect under selected forging conditions is then predicted, using a finite element analysis model. The billet can then be positioned and forged under conditions which cause the defect to move to a non-critical area of the article. In this manner, a billet which might otherwise be discarded or set aside can often be retained for a useful purpose. Related articles are also described.

17 Claims, 7 Drawing Sheets

METHOD FOR POSITIONING DEFECTS IN METAL BILLETS

BACKGROUND OF THE INVENTION

In a general sense, this invention relates to the forging of metals. More specifically, it relates to methods for reducing the amount of metal which is scrapped, before or during the forging process.

Large, forged articles are used in a variety of industrial applications. The articles can be formed from many metals and metal alloys, such as titanium, steel, and nickel-based superalloys. As an example, turbine engine components, such as turbine wheels or discs, are usually formed from superalloy materials. As another example, a medical prosthesis can be formed (e.g., by forging) from a titanium material. These types of articles are usually formed from billets, which had previously been forged from cast ingots. In some instances, the billets are up to about 2–3 meters in length, and 60 centimeters in thickness. They may weigh up to about 20,000 pounds (about 9000 kg). The cost of obtaining and processing the billets increases greatly with their size. The billets themselves are forged into the articles by various techniques, such as upset forging, hammer forging, and extrusion. Those familiar with the art understand that a billet can undergo dramatic changes in shape, grain size, and chemical homogeneity, during the forging operations.

Billets can contain a variety of melt-related defects, e.g., foreign bodies or "pipe". For example, "hard alpha inclusions" of nitrogen, titanium or various silicates (or some combination thereof) sometimes appear in titanium billets. Similarly, a variety of defects can sometimes appear in superalloy billets. These defects, which are often introduced during the primary forming processes, can serve as initiation sites for points of weakness and potential failure of articles formed from the billet.

The defects in the billet can be detected by a variety of non-destructive techniques, which are described below. As an example, ultrasonic inspection can be employed, since the defects usually reflect at least a portion of an ultrasonic beam. Ultrasonic techniques are very useful for determining the size and location of defects.

In general practice, inspection of the billet for defects does not occur until completion of one of the primary forming processes, such as forging. If one or more defects are found at that stage, their position, size, and content are evaluated. If the defects represent significant, potential failure sites for the forged billet (and if they cannot be efficiently removed, e.g., by machining), the billets often must be discarded, or set aside for re-melting.

However, discarding a billet after it has been subjected to one or more forming operations can represent a considerable waste of time and resources. Thus, attempts may be made to machine away or otherwise remove discovered defects. Unfortunately, if the billet has already been subjected to a "final forging" operation, this may prove impractical. Having to repeat the entire forming process with a new casting can greatly increase overall manufacturing costs—especially in the case of very large billets.

With these concerns in mind, new methods for efficiently forging various types of billets would be welcome in the art. Specifically, the methods should reduce the amount of metal scrapped during the forging process. For example, the methods could reduce scrap by "rehabilitating" a greater number of billets. In other words, useful processes would eliminate defects at a relatively early stage of the overall forming process, or minimize the significance of those defects. The new methods should also not adversely affect the billets. Furthermore, the methods should be compatible with the overall forming processes, e.g., by not adding excessive costs to those processes.

SUMMARY OF THE INVENTION

In response to some of the needs described above, the present inventors have discovered a method for positioning at least one defect in a metal billet, during the forging of the billet into a selected article. The method includes the following steps:

(a) determining the size and location of the defect in the billet;

(b) predicting the movement of the defect under selected forging conditions, using a finite element analysis model; and (c) forging the metal billet into the selected article, under forging conditions which cause the defect to move to a desired location, i.e., a non-critical area of the selected article.

Step (a) is usually carried out by a non-destructive testing method, such as ultrasonic inspection. The billet itself can be formed of a variety of materials described below, such as a superalloy. It is often being forged into a turbine engine article, e.g., a turbine disc. The defects (e.g., foreign particle inclusions and dirt) are those common to the material forming the billet, and are well-known to those skilled in the art. Typical titanium defects were described above. Typical superalloy defects (especially in the case of nickel-based superalloys) are freckles (e.g., niobium-rich particles), "white spots" (niobium-deficient particles), "dirty white spots" (e.g., those containing oxides, nitrides, or other contaminants); voids, cracks, and oxides.

As used herein, the term "forging" is meant to include a wide variety of metal-forming processes. Non-limiting examples include open-die forging, cogging, closed-die forging, heading, upsetting, indenting, coining, press forging, extrusion (e.g., extrusion-into-a-die); back-extrusion, potting, hammer forging, flashless and near-net-shape forging; roll forging, roll forming, ring-rolling, shear forming, rotary forging, hot die forging, and isothermal forging. Sometimes, forging processes are generally classified according to temperature conditions: "hot forging", "cold forging", or "warm forging" (for intermediate temperatures).

In a typical embodiment, the movement of the defect is first analyzed under very specific conditions for forging, using the finite element analysis model. These conditions include the selection of a specific forging apparatus, e.g., a forging press. The billet is then positioned relative to markings on the forging press. The exact position of the billet is determined by reference to the finite element model. Forging the billet in the selected position induces the defect to move to a non-critical area of the selected article during the forging step. For example, the defect would be induced to migrate to an area which would eventually be machined out of the article. Thus, this invention is useful for successfully mitigating the presence of a variety of defects in a billet.

The present invention can enhance the manufacturing process for many different types of metal articles. Various turbine engine components provide some examples: shrouds, casings; buckets and blades; nozzles and vanes; wheels and discs. The manufacture of various other types of articles (many of which are forged) can also benefit from this invention, e.g., medical prostheses.

An additional embodiment claimed for this invention relates to a forged article. The article is characterized by the presence of at least one defect in a non-critical area. Moreover, the article is free of defects in critical areas, as described below.

Further details regarding the various features of this invention are found in the remainder of the specification, and in the accompanying drawings.

DETAILED DESCRIPTION OF THE INVENTION

Figure 1:
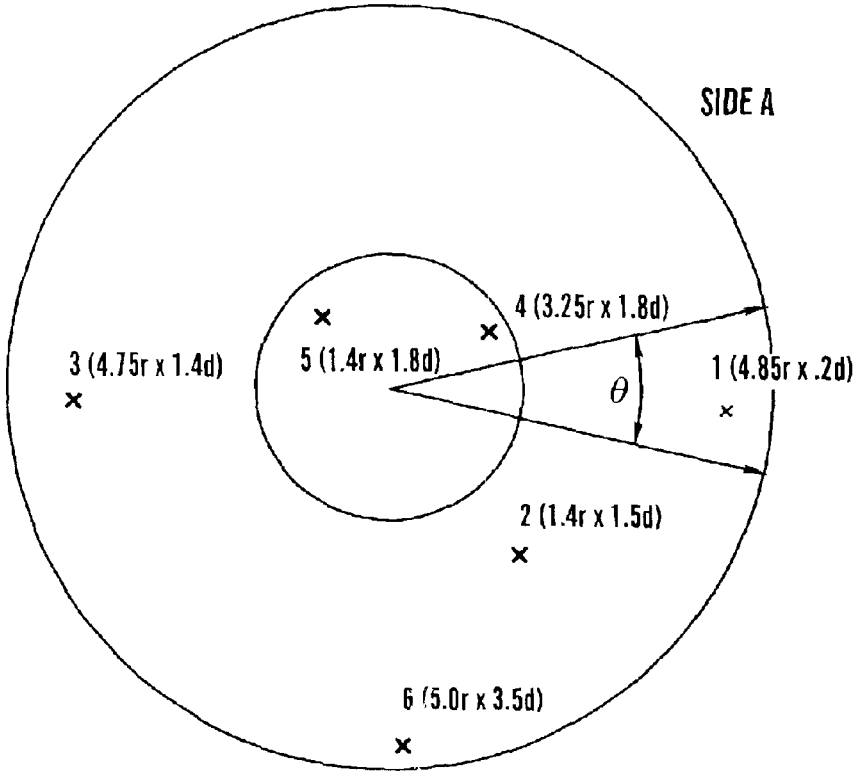
FIG. 1 is a top-view of a billet formed of a metallic material.

As used herein, the term "billet" is meant to generally describe a semi-finished metal product of relatively uniform section and properties. Billets are larger in cross-section than other types of forging stock, such as "bars", and usually have a cross-sectional dimension of at least about 15 cm. As alluded to previously, the billets are typically formed from cast ingots. They can be made from a variety of metals and metal alloys, such as those based on titanium, iron; iron-based alloys like steel; nickel, cobalt, nickel- and cobalt-based superalloys; aluminum, magnesium, zirconium; niobium, and various combinations thereof.

As alluded to previously, details regarding forging are well-known in the art. Non-limiting examples include the "Encyclopedia Americana", Americana Corporation (1964), Volume 11, pp. 485–486, and Volume 25, pp. 562–577; Kirk-Othmer "Encyclopedia of Chemical Technology", Third Edition, Volume 15, pp. 330–334 (1981); and the "Forging Industry Handbook", edited by J. Jenson, Ann Arbor Press, Inc. (1966). These references are incorporated herein by reference. As one example, the upsetting machine, which is a type of mechanical press, is often used to axially compress a billet or other type of bar stock. (Sometimes a portion of the billet is gripped between clamping dies during the upsetting process).

When the article being manufactured is a turbine engine component, the billet is usually formed from a superalloy. Such materials are typically nickel-, cobalt-, or iron-based. Illustrative nickel-base superalloys include at least about 40 wt % Ni, and at least one component from the group consisting of cobalt, chromium, aluminum, tungsten, molybdenum, titanium, niobium, and iron. Illustrative cobalt-base superalloys include at least about 30 wt % Co, and at least one component from the group consisting of nickel, chromium, aluminum, tungsten, molybdenum, titanium, and iron.

In the present invention, the size and location of at least one defect in the billet is first determined. In preferred embodiments, a non-destructive testing method is used to evaluate the defect. These tests are well-known in the art, and described in many references. Examples include the "Forging Industry Handbook" text mentioned above, pages 324–328, which is incorporated herein by reference. Non-limiting examples of such tests include visual inspection (e.g., with a liquid penetrant); ultrasonic inspection, infrared inspection, magnetic particle techniques, eddy current analysis, and ionizing beam radiation methods (e.g., x-ray analysis). Two or more of these tests can sometimes be used in combination, as well. For example, one technique could be used to ascertain the presence of a defect, and another technique would then be used to determine its exact location.

Ultrasonic processes are especially useful for inspecting billets for one or more defects. Various techniques are available, e.g., laser ultrasonic inspection. Moreover, many different types of ultrasonic systems are available, such as an immersion ultrasound device. In some systems, the defects reflect at least a portion of an ultrasonic beam directed through the billet. As those skilled in ultrasonic technologies understand, the deflection in the path of the beam causes a reflection of some of the associated energy, thus depleting the energy transmitted. This in turn causes an acoustic shadow, which can be monitored by a nearby detector placed opposite a transducer (energy source). Many other details regarding ultrasonic inspection devices are well-known in the art. The ultrasonic technique usually should be capable of locating the defect in terms of a "3-dimensional" coordinate system (as described below), or should be capable of being modified to do so.

In some preferred embodiments, a pulse-echo ultrasonic technique is employed to inspect the billet. For such a technique, the acoustic energy is introduced as a very short burst. In this instance, the reflected energy coming back to the originating transducer can be monitored to very effectively show the size and location of the defects. Various types of pulse-echo techniques are well-known in the art. Non-limiting sources for relevant information include U.S. Pat. Nos. 5,915,277; 5,629,865; 5,533,401; and 5,167,157. All of these patents are incorporated herein by reference.

Figure 2:
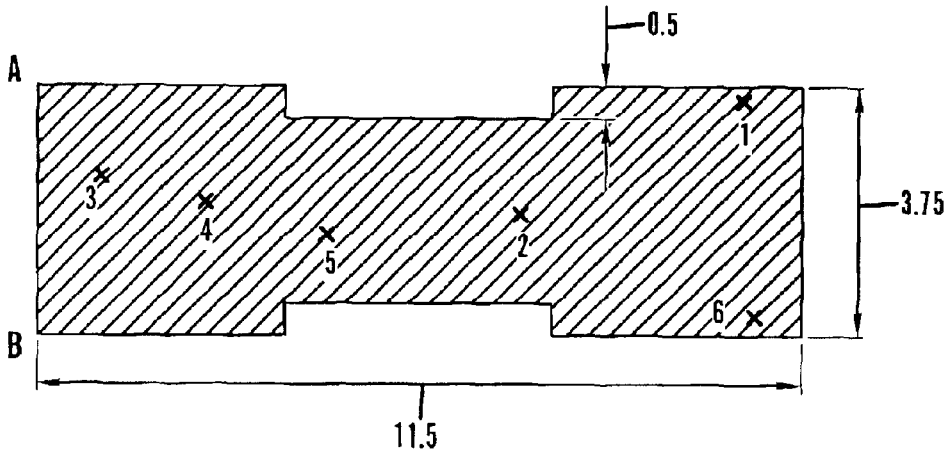
FIG. 2 is a cross-sectional view of the billet of FIG. 1.

FIGS. 1 and 2 simply demonstrate the capacity to examine a metal mass for defects, using a typical ultrasonic technique. (A conventional type of ultrasonic apparatus was employed. It included a 10 mHz transducer.) FIG. 1 is a top-view of a small, cylindrical, sample billet (sometimes referred to as a "mult"), having a diameter of about 11.5 inches (29.2 cm). FIG. 2 is a cross-sectional view of FIG. 1, showing a billet height of 3.75 inches (9.5 cm). The billet was formed from a titanium-based material commercially known as "Ti-6–4". This material contains 6% aluminum, 4% vanadium, with the balance being titanium. Six synthetic defects or "seeds" were emplaced within the billet, through drilled holes. After the seeds were put into place, the holes were sealed by a brief forging step.

Each seed (numbered 1 through 6) was formed of a material which primarily contained titanium and nitrogen. The composition of the seeds is meant to closely resemble the composition of a typical "hard alpha inclusion" which might be present in a titanium billet. Seeds 1 and 2 contained about 1.5% nitrogen, by weight. Seeds 3–6 contained about 12% nitrogen.

It is readily apparent from FIGS. 1 and 2 that the location of each seed can be accurately determined. The dimension "r" represents the radius from the center of the forging. The dimension "d" represents the depth from the top-surface of the forging. Moreover, the dimension of each seed can also be precisely determined, using the ultrasonic device. As an example, seeds 1 through 4 had a length and diameter of 0.200 inch (0.51 cm), while seeds 5 and 6 had a length of 0.200 inch (0.51 cm) and a diameter of 0.100 inch (0.25 cm).

It should be noted that the location of each seed within a billet can be expressed in a number of ways. Various types of coordinate systems related to the geometry of an object can be employed, as mentioned below. This topic is also discussed in a variety of references. One example is "Calculus and Analytic Geometry", G. B. Thomas, Jr., (Alt. Edit.), Addison-Wesley Company (1972), pp. 547–550; 615–618 and 657–659, which is incorporated herein by reference.

In the case of a billet which is generally cylindrical, it is frequently convenient to use cylindrical coordinates (r, θ, z) to locate the position of the defect. As those skilled in the art understand, r and θ can be viewed as polar coordinates analogous to the Cartesian coordinates (x, y) in a single plane, but with θ representing an angular quantity, i.e., as shown in FIG. 1. The coordinate "z" (not shown in the figure) represents the vertical component, i.e., the height of the cylinder. (See, specifically, for example, pages 615–617 and FIG. 13–3 of the Thomas text). In this manner, all possible locations of the defect can be expressed. The location of the defect, or multiple defects, can then be marked or "indexed" on the exterior of the billet by any convenient technique. For example, a chalk or paint mark can be made on the billet, or some reference to a feature on the surface of the billet can be made.

Figure 3:
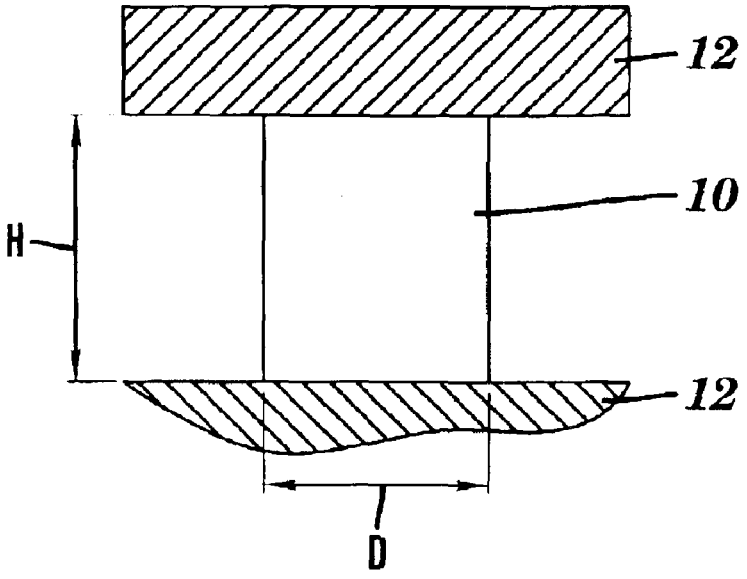
FIG. 3 is a side-elevational view of a cylindrical billet emplaced in a forging apparatus.
Figure 4:
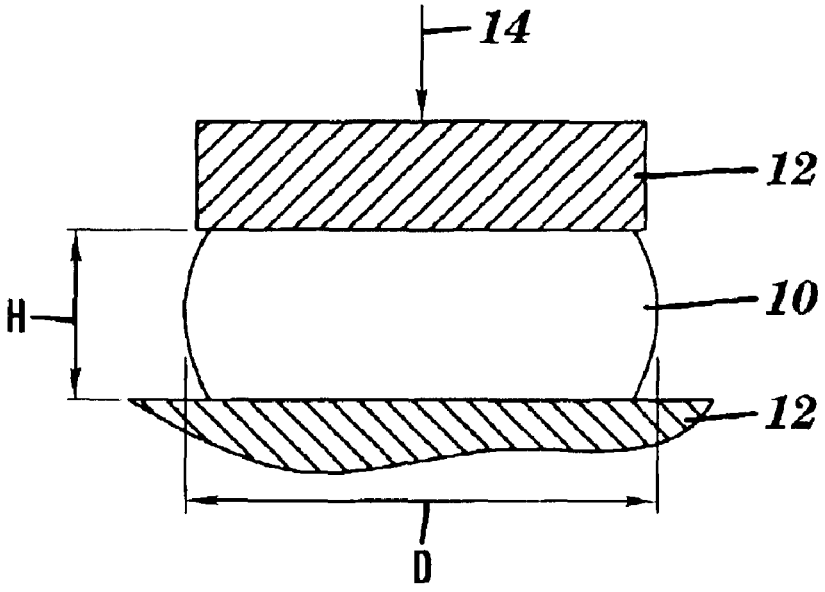
FIG. 4 is a view of the billet of FIG. 3, during the forging process.

As mentioned previously, the shape of billets can be altered dramatically during various metal forming processes. FIGS. 3 and 4 provide a simple illustration of this phenomenon. FIG. 3 depicts the emplacement of a cylindrical billet 10 within a conventional apparatus 12 for upset forging. As shown in FIG. 4, the billet is compressed (pressure arrow 14) within the apparatus. This type of forging is usually carried out at very high temperature, e.g., about two-thirds of the melting point of the metal or metal alloy. (The specific forging temperature can vary significantly, though, depending on factors like flow stress and desired microstructure). The resulting strain gradually reduces the height H of the billet, with a consequential increase in its diameter D (FIG. 4). Such a forming operation also induces any defects in the billet (e.g., like the seeds of FIGS. 1 and 2) to migrate in various directions throughout its structure.

Thus, in preferred embodiments, the next step in the process is to predict the migration of the defects, i.e. in terms of distance and direction. As mentioned above, the prediction is based on the use of a finite element analysis model. In general, finite element analysis is well-known in the art of structural analysis. Many examples can be provided. The following references are exemplary: "Numerical Modelling of Material Deformation Processes—Research, Development and Applications", P. Hartley et al (Eds.), Springer-Verlag (1992) pp. 20–23; 252–273; "Applied Finite Element Analysis for Engineers", F. Stasa, CBC College Publishing (1985); and "The New Encyclopedia Brittanica", V. 23 (Macropedia (1994)), p. 739, all of which are incorporated herein by reference. Finite element analysis is also described in many patents, such as U.S. Pat. Nos. 5,569,860; 5,402,366; 5,377,116; 5,106,012; 4,912,664; and 4,762,679. These patents are also incorporated herein by reference.

Figure 5:
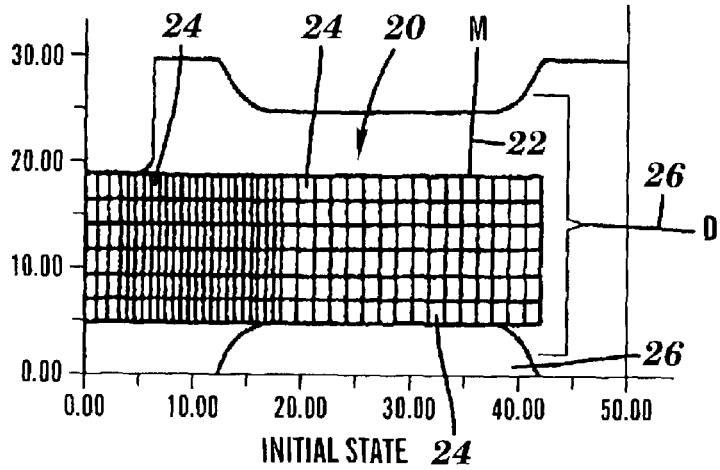
FIG. 5 is an elevated view of a portion of a forging apparatus and an article contained therein, wherein the article is graphically divided into elements according to a finite element analysis technique.

Typically, the material undergoing deformation (e.g., upset forging) is first divided or "meshed" into a plurality of elements, i.e., finite element meshes. FIG. 5 provides a simple illustration of a bar or billet 20, formed of a metal or metal alloy material ("M") 22. (The exact shape of the bar is not particularly important for this illustration). As part of a computer simulation, the material 22 is divided into a plurality of finite element meshes 24. In FIG. 5, the bar 20 has been placed in a die 26 ("D") of a conventional forging apparatus (not shown in its entirety). The dimensions of the bar in its initial state are apparent from the vertical and horizontal axes, which are divided into arbitrary units.

As those skilled in finite element analysis understand, a simulation is carried out for bar 20, typically using a computer system and software specifically designed for this purpose. The simulation predicts changes which occur in each finite element mesh 24, during a forming operation, e.g., during the compression of the billet shown in FIGS. 3 and 4. The data used in the simulation relates to well-known mechanical equations-of-state, e.g., those which evaluate the behavior (e.g., flow behavior) of a material when a load is applied to it.

These equations-of-state can be derived from physical constants and selected physical properties for the particular material forming the bar. Non-limiting examples of the physical constants and properties are elastic moduli, strength, flow stress-versus-strain at a given temperature; and strain rate sensitivity. (Equations relating to the distribution of forces and displacements of a finite element model are sometimes referred to as "stiffness equations").

Very often, the physical constants and properties can be found in the literature. This is typically the case for pure metals, such as nickel or titanium, and for many commercial alloys, such as Alloy 718 (nickel-based) and Ti-6-4 (titanium-based). Alternatively, though, the required data can be obtained by testing specimens of the material being examined. An illustration in the case of a sample which is to be forged is appropriate: Forging is an operation which involves predominantly compressive states of stress. Thus, flow curves can first be generated, using standard compression tests, e.g., those which measure load as a function of extension; or load as a function of compression. The flow curves can then be used to calculate the necessary characteristics, e.g., flow stress values, strain rates, and the like.

As alluded to above, many computer programs for performing finite element analysis are available. Non-limiting examples include ANSYS™, available from Swanson Analysis Systems, Inc., of Houston, Pa.; and DEFORM™, available from Scientific Forming Technologies Corporation, Columbus, Ohio. Moreover, it should be noted that many of these programs have been adapted specifically for forging-type operations. In other words, they can accept and efficiently process the selected data obtained from flow curves and the like for a given material, as discussed previously.

Figure 6:
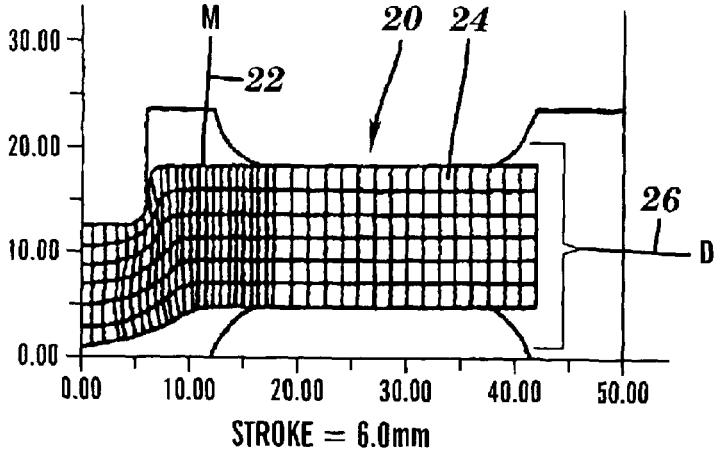
FIG. 6 is a view of the article and forging apparatus of FIG. 5, during a deformation process.
Figure 7:
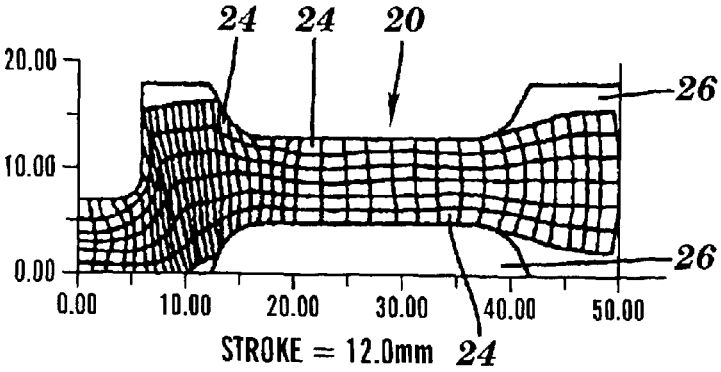
FIG. 7 is another view of the article and forging apparatus of FIG. 5, farther along in the deformation process.

FIG. 6 is another simulation of bar 20, after an initial forging operation. Die 26 has been moved from an initial state to an intermediate state, at a stroke of 6.0 mm. The effect of these compressive forces is apparent from the finite element mesh. FIG. 7 is a simulation, after forging at a stroke of 12.0 mm. Again, the effect of the additional amount of compressive force is apparent from the mesh. The shape of bar 20 has changed considerably.

Figure 10:
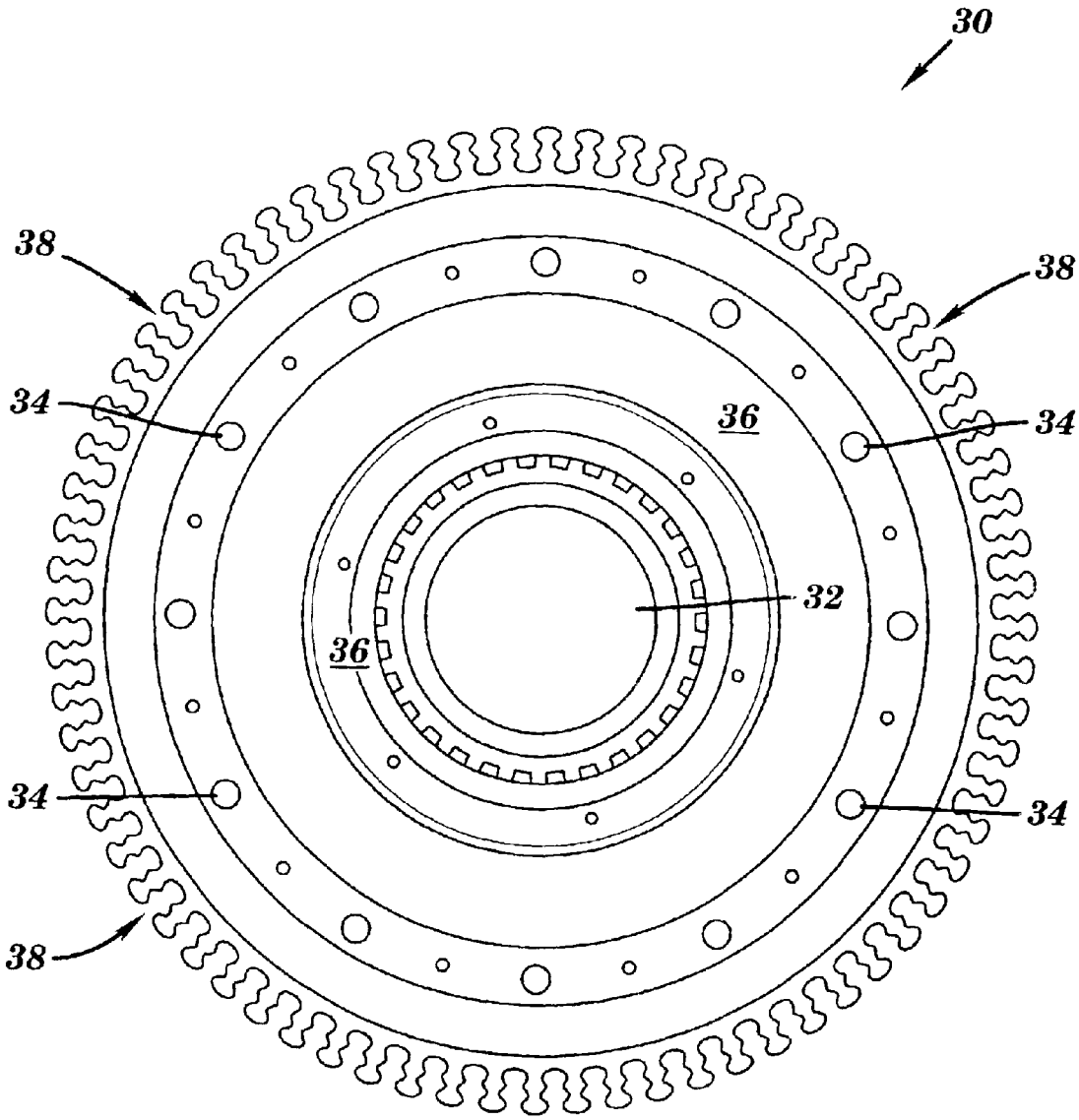
FIG. 10 is a photograph of one of the planar surfaces of a turbine disc.

Another example of the finite element process is described in the P. Hartley et al reference listed above, "Numerical Modelling of Material Deformation Processes". A demonstrative simulation of the open-die forging of a circular bar is provided in the reference (pages 257–258), and need not be duplicated here. In brief, a bar described therein, 200 mm in diameter, has a shape typical of a turbine blade forging. It is shown as being compressed between two platens. FIG. 10.1 of the Hartley text depicts the bar in its initial state. FIG. 10.2 (*a–d*) show the distorted meshes under increasing pressure (successive reduction of 20%, 30%, 40%, and 50%, respectively). The mesh-pattern clearly indicates how the compressed material is moving away from the vertical center-line of the work-piece. Displacement vectors are typically used to indicate the incremental displacement of each nodal point in the mesh.

Various other details regarding finite element analysis are also known in the art. For example, different types of coordinate systems can be used to describe the geometry of a deforming solid. The Hartley text (e.g., pages 22 et seq.) provides an illustration, using Cartesian coordinates and intrinsic coordinates of material points. Some of the other factors considered in designing a finite element model may relate to boundary conditions, die movement, friction properties, thermal conductivity of the billet material and of the die; and the overall heat transfer coefficient. Those skilled in this area will be able to determine which of these factors requires consideration for a given work-piece.

Figure 8:
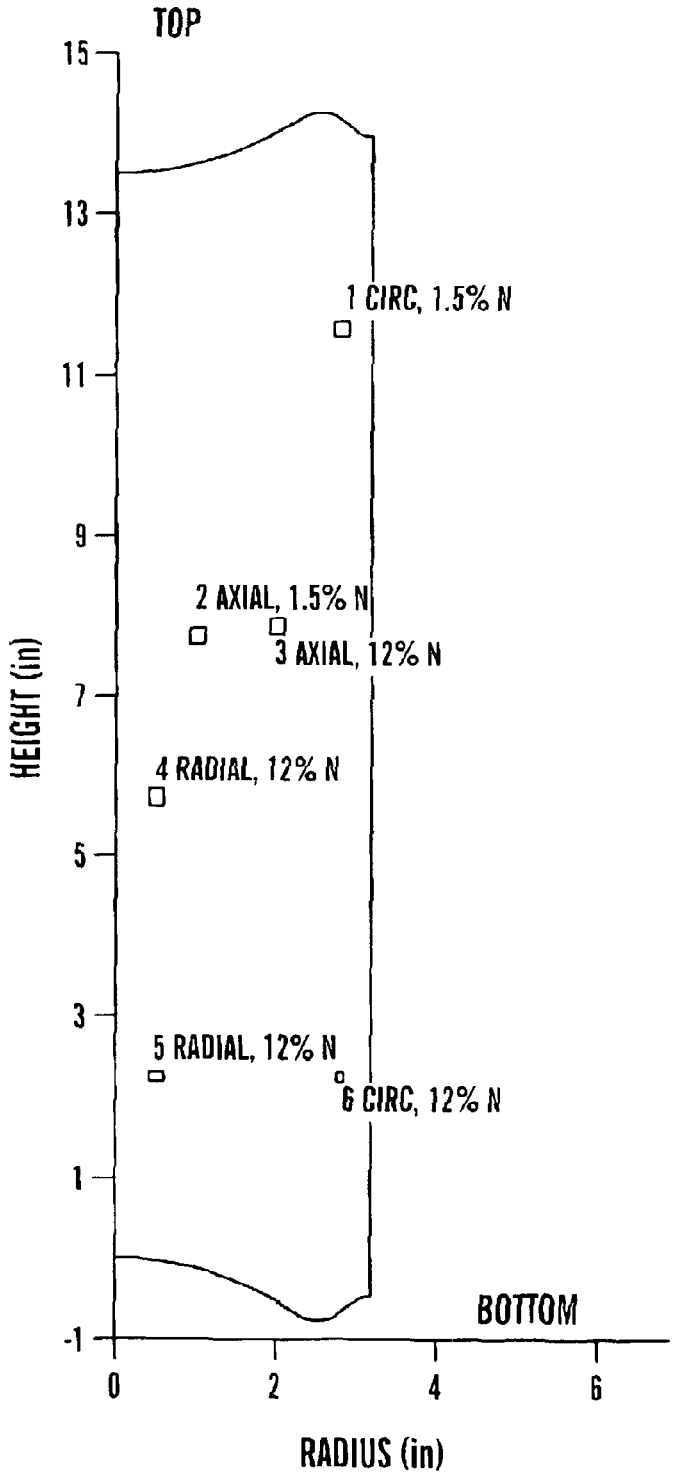
FIG. 8 is a partial cross-section of a billet, graphically depicting the location of defects contained therein.

FIG. 8 is a graphical representation of an actual cylindrical billet (one-half-radius section), having a height of approximately 13.5 inches (34.3 cm). The billet was formed of the Ti-6-4 material described previously. Six synthetic seeds (defects), numbered 1–6, had previously been incorporated into the billet, in the manner described above. The seeds were generally cylindrical in shape.

The precise location of the seeds, marked by the small squares, was determined by an ultrasonic technique. Seed 1 has its cylindrical axis lying in the circumferential ("circ") direction of the billet. The seed contains 1.5% nitrogen. Seed 2 has its axis parallel ("axial") to the axis of the forging. It also contains 1.5% nitrogen. Seed 3 also has an axial orientation, and includes 12% nitrogen. Seeds 4 and 5 have a radial orientation, i.e., their axes are generally aligned with the radius of the billet. Both of these seeds contain 12% nitrogen. Seed 6 is also aligned circumferentially with the billet, and contains 12% nitrogen. The 1.5%–12% nitrogen content was intended to exemplify the typical range for nitrogen in a defect of this type.

The actual billet of FIG. 8 was forged under standard conditions, as follows:

| | |
|---|---|
| Forge Mult Temperature: | 1750° F. (954° C.); |
| Die Temperature: | 900° F.–1000° F. (482° C.–538° C.) at surface; 800° F. (427° C.) in die interior; |
| Die Speed | 0.776 in/sec (1.97 cm/sec); |
| Die Load | 4500 tons ($4.08 \times 10^6$ kg); |
| First Push Stroke: | 10.56 in. (26.8 cm) (center-line thickness); |
| Second Push Stroke | 1.05 in. (2.7 cm) (outer diameter thickness). |

Figure 9:
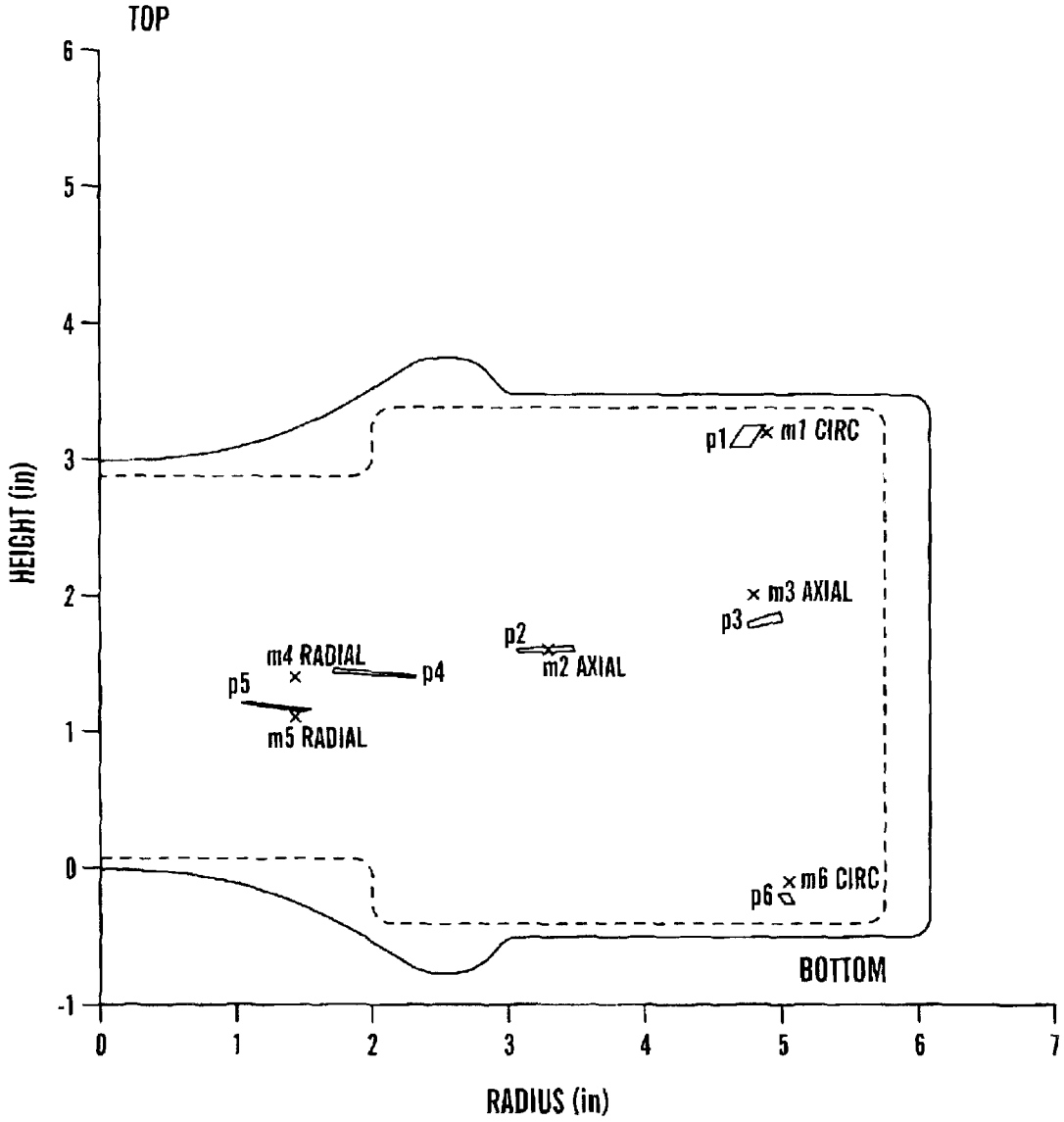
FIG. 9 is a partial cross-section of the billet of FIG. 8, after the completion of a forging step.

FIG. 9 is a graphical depiction (one-half radius section) of the billet of FIG. 8, after forging. (The solid line represents the actual forging shape). The units on the horizontal and vertical axes demonstrate the change in the dimensions of the billet. The prediction for seed migration was carried out by using the DEFORM™ finite element analysis program mentioned above. The conventional input parameters for the finite element model were derived from strain data, strain-rate data, and temperature-related data. This data had been obtained beforehand, using a flow stress meter, for a number of specimens of the particular Ti-6-4 alloy.

The migration of the seeds (i.e., defects) during forging is readily apparent from FIG. 9. The predicted area ("p") in which the migrating seeds (seeds 1 through 6) would be located is indicated by the quadrilateral shape. In this figure, the measured location ("m") of each seed is indicated by an "x" mark. The orientation of each seed is indicated in the figure also, e.g., circumferential, axial, or radial, as discussed above. FIG. 9 demonstrates that the movement of a defect during forging can be predicted very accurately, using the finite element analysis model.

Moreover, the final position of the defect can be influenced by altering the forging conditions described previously. It should thus be apparent that the billet can be forged in a manner which will cause the defect (or multiple defects) to migrate to selected areas of the final article. (Performance and material specifications for any particular article of manufacture are known to those involved in the particular industry). Usually, these areas are those which are non-critical to the performance or integrity of the article. As an example, the defect can be shifted to a region which will eventually be machined or otherwise removed from the article.

Figure 11:
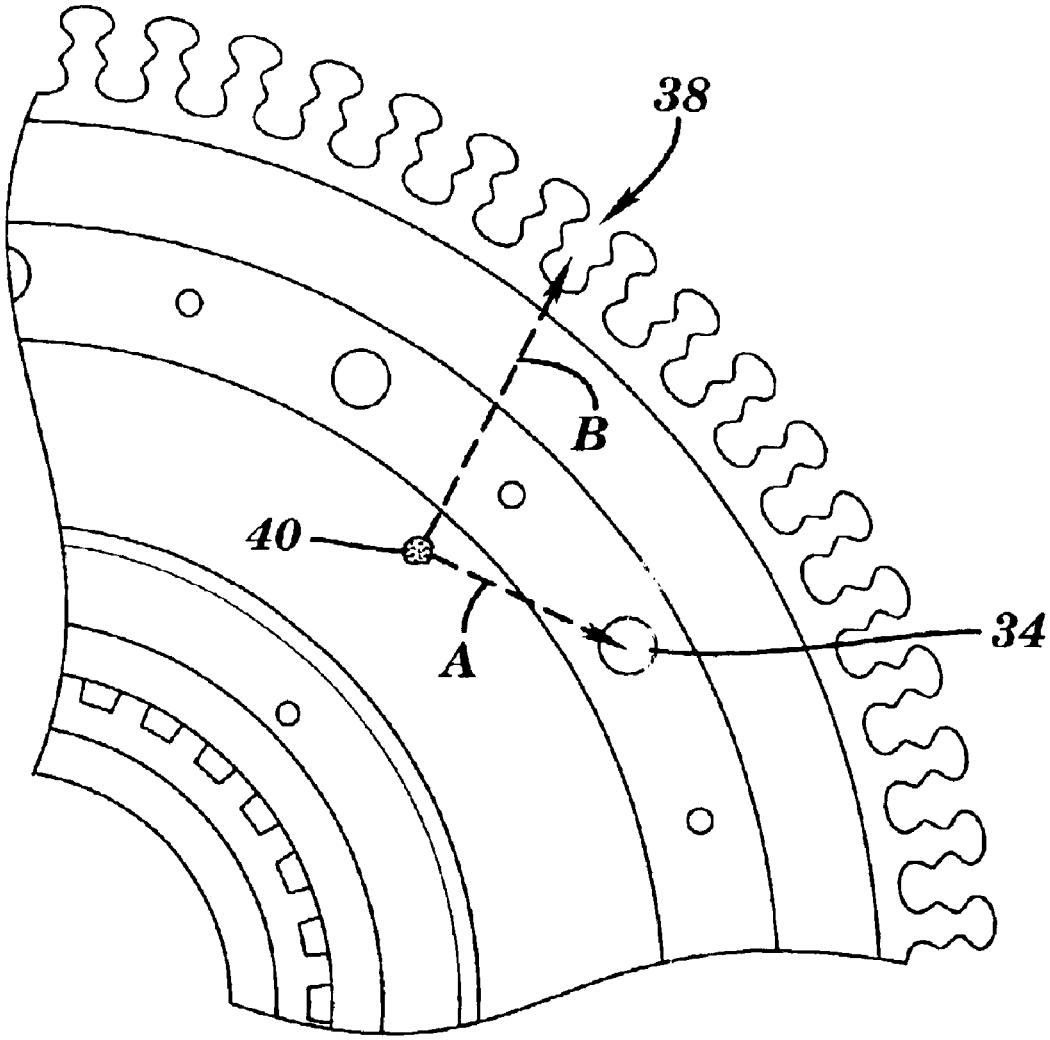
FIG. 11 is a section of the photograph of FIG. 10, showing a portion of the surface of the turbine disc.

FIGS. 10 and 11 provide an illustration of the induced migration of a defect, according to this invention. FIG. 10 is based on a photograph of one of the planar surfaces of a turbine disc or "wheel" 30, which constitutes part of a turbine engine. The wheel, formed of a nickel-based superalloy, was upset-forged from a small billet, and then machined. The wheel includes a central opening 32, which will usually accommodate a splined shaft. There are also a number of circumferential bolt holes 34, which penetrate surface 36 and extend through the thickness of the wheel. The bolt holes usually accommodate bolts which attach the wheel to an adjacent section of the turbine engine.

On its outer circumference, wheel 30 includes a large number of dovetail slots 38. These slots are meant to accommodate and "lock in" turbine blades (not shown). Those skilled in the art understand that turbine blades typically include a dovetail terminus which is shaped to engage each dovetail slot. Slots 38 and bolt holes 34 reside in locations which were initially solid metal. They can be formed by a number of well-known processes. For example, the holes can be formed by any type of boring technique, such as piercing, drilling, or laser-machining. The slots are usually formed by a machining technique, such as grinding, broaching, or electrical discharge machining. A combination of techniques may be used to achieve the final dimensions of each hole and slot, since their shape usually has to be very precise.

FIG. 11 is an enlarged section of FIG. 10. Defect 40, e.g., a freckle, has been arbitrarily positioned in FIG. 11. Its initial, predicted position would be determined by the finite element process described above, prior to forging. This position of the defect would usually be unacceptable, since it could adversely affect the integrity of the turbine wheel.

However, the predicted position of defect 40 in FIG. 11 can be shifted, using the process described above. As an example, strain-, strain rate-, and temperature data can readily be obtained for specimens of the superalloy forming the wheel. When this data is incorporated into the finite element analysis program, the movement of defect 40 after a forging operation can be precisely determined, as illustrated previously in FIGS. 8 and 9. The billet which is to be forged can then be positioned in the forging apparatus, based on the finite element analysis model. In this manner, the predicted position of the defect is shifted to a non-critical location.

As one example, the predicted position of defect 40 can be shifted to location 34, as shown by dotted line "A" in FIG. 11. Since the material in this location will be removed, e.g., drilled out, to form the bolt hole, the presence of the defect is inconsequential. As another example, the predicted position of defect 40 can be shifted to location 38, as shown by dotted line "B" in the figure. Since the material in this location will eventually be removed, e.g., machined away, to form the dovetail slot, the defect will also be removed.

Those skilled in the art are familiar with techniques for positioning the billet in the forging apparatus. The particular technique will of course depend on various factors, such as the specific type of forging apparatus; the size, weight, and specific shape of the billet; and its composition. As mentioned previously, the billet is usually marked beforehand, to indicate the position of the defect.

In the case of a typical upsetting machine, the billet can be positioned relative to a coordinate system (e.g., reference marks) made on one or more dies of the forging apparatus. The exact position of the billet is determined by reference to the finite element model. In other words, the predicted amount and direction of movement for the defect (e.g., FIGS. 8, 9) allows the forger to position the billet to induce the defect to move to a non-critical location (e.g., FIGS. 10 and 11). The billet is usually adjusted within the forging machine by rotation or inversion, depending on defect location. Small, sample test billets might be used for trial purposes, to confirm the predicted movement of the defect for a given billet position.

In the case of multiple defects, the finite element analysis model is examined to determine the most efficient forging position for moving each defect to one or more non-critical locations. In some instances, a selected position for the billet will induce each defect to move to such locations. At other times, it may not be possible to position the billet to achieve such a result.

It is also possible to forge the billet in two or more steps. In other words, the billet can be partially forged in one position. Subsequently, the billet would be shifted to another position in the forging die, e.g., by rotation or inversion, based on the data from the finite element analysis model. Forging would then be resumed. Forging could be stopped again, followed by re-positioning of the billet and further forging. In this manner, a defect can be induced to move in a direction that does not have to be "straight-line", but can instead be directed to a variety of "angular" locations within the billet. Multiple forging steps can be especially useful when positioning more than one defect.

As mentioned above, the defect is moved to a non-critical area of the article during the forging step. A "non-critical area" can be any region in which the presence of the defect will not have a substantial, adverse effect on the overall performance and integrity of the article. Alternatively, a non-critical area can be a region which would eventually be removed from the article, e.g., by machining. Conventional techniques can be employed to remove the defect from the article (usually after forging is complete). Examples were provided above, e.g., piercing, drilling, laser-machining, grinding, broaching, or combinations of these techniques.

It should thus be clear that the process described herein allows one to utilize a billet which otherwise might be discarded or set aside because of the presence of a defect in a critical location. In the case of large articles like some of the turbine engine components, this "recovery" of such a billet can result in a significant reduction in manufacturing costs.

Another embodiment of the present invention is directed to a forged article, e.g., a turbine component. The article is characterized by the presence of at least one defect in a non-critical area, as described previously. Moreover, the article is free of defects in critical areas, i.e., regions in which the presence of a defect could adversely affect the performance or integrity of the article. The defects in critical areas have been avoided by forging according to a finite element analysis model, as described previously.

This invention has been described in terms of certain embodiments. However, it is not intended that the invention be limited to the above description. Accordingly, various modifications, adaptations, and alternatives may occur to one skilled in the art without departing from the spirit and scope of the claimed inventive concept. All of the patents, articles, and texts which are mentioned above are incorporated herein by reference.

What is claimed is:

1. A method for positioning at least one defect in a metal billet during the forging of the billet into a selected article, comprising the following steps:

(a) determining the size and location of the defect in the billet;

(b) predicting the movement of the defect under selected forging conditions including a selected for in apparatus, using a finite element analysis model to determine a position of the billet relative to the selected forging apparatus;

(c) positioning the billet at the position relative to the selected forging apparatus with reference to the finite element analysis model; and (d) forging the billet into the selected article, under forging conditions which cause the defect to move to a non-critical area of the selected article, wherein the forging conditions include the position of the billet relative to the selected forging apparatus.

2. The method of claim 1, wherein step (a) is carried out by at least one non-destructive testing method.

3. The method of claim 2, wherein the non-destructive testing method is selected from the group consisting of visual inspection, ultrasonic inspection, magnetic particle techniques, eddy current analysis, ionizing beam radiation methods, infrared inspection, and combinations of these techniques.

4. The method of claim 3, wherein the ultrasonic inspection method is a pulse-echo technique.

5. The method of claim 1, wherein the defect is selected from the group consisting of hard alpha inclusions, slag, dirt, freckles, white spots, dirty white spots, voids, cracks, oxides; and combinations thereof.

6. The method of claim 1, wherein the billet comprises a material selected from the group consisting of titanium, iron; iron-based alloys, nickel, cobalt, nickel- and cobalt-based superalloys; aluminum, magnesium, zirconium; niobium, and combinations thereof.

7. The method of claim 6, wherein the superalloy is nickel-based.

8. The method of claim 1, wherein the selected article is a component of a turbine engine.

9. The method of claim 8, wherein the component is selected from the group consisting of shrouds, casings, buckets, blades, nozzles, vanes, wheels, and discs.

10. The method of claim 1, wherein step (d) is carried out by a technique selected from the group consisting of open-die forging, cogging, closed-die forging, heading, upsetting, indenting, coining, press forging, potting, extrusion, back-extrusion, hammer forging, flashless and near-net-shape forging; roll forging, roll forming, ring-rolling, shear forming, rotary forging, hot die forging, and isothermal forging.

11. The method of claim 1, wherein the area of the selected article which contains the defect is removed from the article after step (d).

12. The method of claim 11, wherein removal of the defect is carried out by a technique selected from the group consisting of piercing, drilling, laser-machining, electrical discharge machining, grinding, broaching, and combinations of these techniques.

13. The method of claim 1, wherein forging step (d) is carried out in at least two steps.

14. The method of claim 13, wherein the billet is re-positioned before each forging step, after the first forging step.

15. The method of claim 1, wherein more than one defect in the metal billet is positioned.

16. A method for forming a superalloy turbine engine article from a billet of the superalloy material, comprising the following steps:

(I) determining the size and location of at least one defect in the billet, using a technique that includes ultrasonic inspection, wherein the defect is selected from the group consisting of white spots, dirty white spots, voids, cracks, oxides and combinations thereof;

(II) predicting the movement of the defect under selected conditions for forging including a selected forging apparatus, using a finite element analysis model to determine a position of the billet relative to the selected for in a apparatus;

(III) positioning the billet in the selected forging apparatus, at the position with reference to the finite element analysis model, so that forging will cause the defect to move to a region of the superalloy turbine engine article which will be removed after forging; and then (IV) forging the billet into the superalloy turbine engine article.

17. The method of claim 16, wherein the region of the forged article containing the defect after step (IV) is removed from the article by a technique selected from the group consisting of piercing, drilling, laser-machining, grinding, broaching, electrical discharge machining, and combinations of these techniques.

* * * * *

UNITED STATES PATENT AND TRADEMARK OFFICE

CERTIFICATE OF CORRECTION

PATENT NO. : 6,909,988 B2
DATED : June 21, 2005
INVENTOR(S) : Batzinger et al.

It is certified that error appears in the above-identified patent and that said Letters Patent is hereby corrected as shown below:

Column 10,
Line 34, "forging conditions including a selected for in apparatus," should read
-- forging conditions including a selected forging apparatus, --.

Signed and Sealed this

Twenty-seventh Day of December, 2005

JON W. DUDAS
*Director of the United States Patent and Trademark Office*